US010437171B2

(12) United States Patent
An et al.

(10) Patent No.: US 10,437,171 B2
(45) Date of Patent: Oct. 8, 2019

(54) DEVELOPING DEVICE, PROCESS CARTRIDGE AND IMAGE FORMING APPARATUS

(71) Applicant: CANON KABUSHIKI KAISHA, Tokyo (JP)

(72) Inventors: Koji An, Tokyo (JP); Kazunari Hagiwara, Yokohama (JP); Takaaki Shinkawa, Tokyo (JP); Takashi Mukai, Kawasaki (JP); Takuya Kitamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/141,800

(22) Filed: Sep. 25, 2018

(65) Prior Publication Data

US 2019/0101847 A1 Apr. 4, 2019

(30) Foreign Application Priority Data

Sep. 29, 2017 (JP) ..... 2017-191931

(51) Int. Cl.
*G03G 15/08* (2006.01)
*G03G 21/18* (2006.01)

(52) U.S. Cl.
CPC ..... *G03G 15/0812* (2013.01); *G03G 21/1814* (2013.01)

(58) Field of Classification Search
CPC ..... G03G 15/0812; G03G 21/1814
See application file for complete search history.

(56) References Cited

U.S. PATENT DOCUMENTS

| | | | | |
|---|---|---|---|---|
| 8,948,665 | B2 * | 2/2015 | Kase | G03G 15/0812 399/284 |
| 10,108,108 | B2 * | 10/2018 | Seki | G03G 15/0812 |
| 2015/0030356 | A1 * | 1/2015 | Zona | G03G 15/0812 399/284 |

FOREIGN PATENT DOCUMENTS

| | | | |
|---|---|---|---|
| JP | 3-48876 | A | 3/1991 |
| JP | 04-086854 | A | 3/1992 |
| JP | 2012-113208 | A | 6/2012 |
| JP | 2017-134437 | A | 8/2017 |

* cited by examiner

*Primary Examiner* — Gregory H Curran
(74) *Attorney, Agent, or Firm* — Canon USA, Inc., IP Division

(57) ABSTRACT

A regulating portion includes a first contact portion, a second contact portion, opposed surface portion, and a second opposed surface portion. When, in a plane orthogonal to the rotation axis direction of a developer bearing member, the fixed end and the free end of a supporting member are connected by an imaginary straight line, a contact position where the first contact portion contacts the developer bearing member is located on the downstream side, in the rotation direction of the developer bearing member, of a point of contact of a tangent line parallel to the imaginary straight line with the outer periphery of the developer bearing member.

16 Claims, 9 Drawing Sheets

DEVELOPING DEVICE, PROCESS CARTRIDGE AND IMAGE FORMING APPARATUS

BACKGROUND OF THE INVENTION

Field of the Invention

The present disclosure relates to a developing device and a process cartridge used in an image forming apparatus such as an electrophotographic printer or an electrophotographic copying machine.

Description of the Related Art

Generally, a developing device includes a developing roller and a developing blade for regulating toner on the developing roller, and the developing blade charges the toner by triboelectric charging while uniformly forming the toner layer on the developing roller.

For example, in Japanese Patent Laid-Open No. 3-48876, one end (fixed end) of a developing blade is supported by a container frame, and the other end (free end) is arranged so as to contact the outer peripheral surface of a developing roller. The free end of the developing blade is arranged on the upstream side, in the rotation direction of the developing roller, of the fixed end.

In Japanese Patent Laid-Open No. 3-48876, by bending the free end (distal end) of the developing blade outwardly, an opposed space (gap) defined by the developing blade and the developing roller is formed on the upstream side, in the rotation direction of the developing roller, of the contact portion. Due to the presence of such an opposed space, the amount of toner taken into the contact portion is increased, and improvement in charging efficiency is also expected.

However, in the configuration of Japanese Patent Laid-Open No. 3-48876, since the opposed space is formed on the upstream side of the contact portion, the contact pressure at the contact portion is likely to decrease. That is, the flowing of toner powder into the opposed space on the upstream side of the contact portion may generate a force for pushing up the developing blade away from the outer peripheral surface of the developing roller. As a result, the contact pressure (or the contact width) of the developing blade with respect to the developing roller decreases, and an image defect due to a decrease in regulating force or chargeability may occur.

SUMMARY OF THE INVENTION

The present disclosure has been made in view of the above circumstances and provides a developing device, a process cartridge, or an image forming apparatus capable of suppressing a decrease in the contact pressure of a developing blade while improving the amount of toner taken into a contact portion.

In an aspect of the present disclosure, a developing device includes a developer bearing member configured to bear developer, a developing frame configured to accommodate developer to be borne by the developer bearing member and rotatably support the developer bearing member, a supporting portion including a fixed end fixed to the developing frame and a free end extending from the fixed end to the upstream side in the rotation direction of the developer bearing member, and a regulating portion provided at the free end of the supporting portion and configured to regulate the thickness of the developer borne on the developer bearing member by contacting with the developer bearing member. The regulating portion includes a first contact portion contacting the developer bearing member, a second contact portion contacting the developer bearing member on the downstream side of the first contact portion in the rotation direction of the developer bearing member, a first opposed surface portion apart from and opposed to the developer bearing member on the upstream side of the first contact portion in the rotation direction of the developer bearing member, and a second opposed surface portion apart from and opposed to the developer bearing member on the downstream side of the first contact portion and on the upstream side of the second contact portion in the rotation direction of the developer bearing member. When, in a plane orthogonal to the rotation axis direction of the developer bearing member, the fixed end and the free end of the supporting member are connected by an imaginary straight line, a contact position where the first contact portion contacts the developer bearing member is located on the downstream side, in the rotation direction of the developer bearing member, of a point of contact of a tangent line parallel to the imaginary straight line with the outer periphery of the developer bearing member.

In another aspect of the present disclosure, a process cartridge includes an image bearing member on which an electrostatic latent image is formed, and the above developing device configured to develop the electrostatic latent image formed on the image bearing member. The process cartridge is detachably attachable to a main body of an image forming apparatus.

In another aspect of the present disclosure, an image forming apparatus includes an image bearing member on which an electrostatic latent image is formed, the above developing device configured to develop the electrostatic latent image formed on the image bearing member, and a fixing portion.

In another aspect of the present disclosure, an image forming apparatus includes the above process cartridge and a fixing portion.

Further features of the present disclosure will become apparent from the following description of exemplary embodiments with reference to the attached drawings.

DESCRIPTION OF THE EMBODIMENTS

The present disclosure can be implemented as any one of a developing device, a process cartridge, and an image forming apparatus.

Hereinafter, an electrophotographic image forming apparatus 100 (hereinafter may be simply referred to as "image forming apparatus 100") in which a process cartridge according to the present disclosure is used will be described with reference to the drawings. It is to be noted that the embodiments described below are illustrative of the present disclosure, and the dimensions, materials, shapes, relative positional relationships, and the like of the constituent components described below do not limit the scope of the present disclosure unless otherwise specified.

Here, the electrophotographic image forming apparatus forms an image on a recording medium (recording material) by using an electrophotographic image forming method. Examples of the electrophotographic image forming apparatus include an electrophotographic copying machine, an electrophotographic printer (for example, a laser beam printer or an LED printer), a facsimile machine, and a word processor.

The process cartridge is a cartridge in which a charging unit, a developing unit or a cleaning unit and a photosensitive drum are integrally placed, and which is detachably attachable to the main body of the electrophotographic image forming apparatus; a cartridge in which at least one of a charging unit, a developing unit, and a cleaning unit and a photosensitive drum are integrally placed, and which is detachably attachable to the main body of the electrophotographic image forming apparatus; or a cartridge in which at least a developing unit and a photosensitive drum are integrally placed, and which is detachably attachable to the main body of the electrophotographic image forming apparatus.

The developing device is formed by integrating a developing unit for developing an electrostatic latent image on a photosensitive drum, a developing frame body supporting the developing unit, and parts related to the developing unit, and is detachably attachable to the main body of the image forming apparatus.

A developing container is a unit for accommodating developer used in the electrophotographic image forming process, and includes a developing frame for accommodating the developer and a stirring unit for sending the accommodated developer.

First Embodiment

Electrophotographic Image Forming Apparatus

Figure 2:
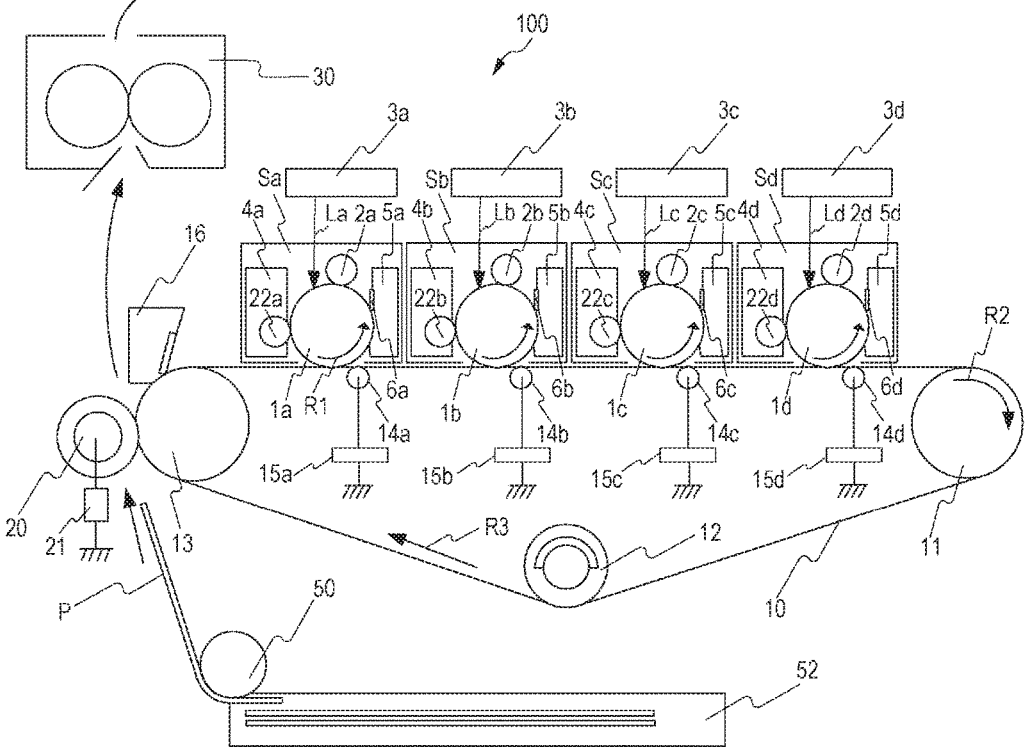
FIG. 2 is a conceptual cross-sectional view of the image forming apparatus according to the first embodiment of the present disclosure.

The overall configuration of the electrophotographic image forming apparatus 100 (image forming apparatus) according to this embodiment will be described with reference to FIG. 2. FIG. 2 is a conceptual cross-sectional view of the image forming apparatus according to the first embodiment.

As shown in FIG. 2, the image forming apparatus 100 of this embodiment is a full-color laser printer using an in-line method and an intermediate transfer method.

Specifically, the image forming apparatus 100 can form a full color image on a recording material P (for example, recording paper or a plastic sheet) according to image information. The image information is input to the image forming apparatus 100 from an image reading device or a host device such as a personal computer communicably connected to the image forming apparatus 100.

The image forming apparatus 100 includes, as a plurality of image forming units, first, second, third, and fourth process cartridges Sa to Sd for forming images of respective colors of yellow (Y), magenta (M), cyan (C), and black (K), respectively. In this embodiment, the first to fourth process cartridges Sa to Sd are arranged in a line in a direction intersecting the vertical direction. In this embodiment, the configuration and operation of the first to fourth process cartridges Sa to Sd are substantially the same except that the colors of the images to be formed are different.

Hereinafter, in the case where distinction is not particularly required, the suffixes (a to d) given to reference signs to indicate colors are omitted, and the description will be given collectively.

In this embodiment, the image forming apparatus 100 includes, as a plurality of image bearing members, four drum type electrophotographic photosensitive members, that is, photosensitive drums 1 (1*a* to 1*d*) arranged side by side in a direction intersecting the vertical direction. The photosensitive drums 1 are rotationally driven by a driving unit (driving source) (not shown). Around the photosensitive drum 1, a charging roller 2 (2*a* to 2*d*), a scanner unit (exposure device) 3 (3*a* to 3*d*), a developing unit (developing device) 4 (4*a* to 4*d*), and a photosensitive drum cleaning device 5 (5*a* to 5*d*) are arranged.

The charging roller 2 is a charging unit for uniformly charging the surface of the photosensitive drum 1. The scanner unit 3 is an exposure unit that irradiates laser light L based on an output calculated by a CPU (not shown) from image information input from a host device such as a personal computer, thereby forming an electrostatic image (electrostatic latent image) on the photosensitive drum 1. The developing unit 4 is a developing unit for developing the electrostatic image as a developer (hereinafter referred to as toner) image.

The photosensitive drum cleaning device 5 is a cleaning unit for removing the toner (transfer residual toner) remaining on the surface of the photosensitive drum 1 after the transfer. The photosensitive drum 1, and the charging roller 2, the developing unit 4, and the photosensitive drum cleaning device 5 as process units acting on the photosensitive drum 1, are integrated to form a process cartridge S. The process cartridge S is detachably attachable to the image forming apparatus 100 via an attachment unit such as an attachment guide or a positioning member provided in the image forming apparatus 100.

An intermediate transfer belt 10 as an intermediate transfer member for transferring the toner image on the photosensitive drum 1 to the recording material P is disposed so as to face the four photosensitive drums 1. The intermediate transfer belt 10 formed of an endless belt contacts all the photosensitive drums 1 and circulates (rotates) in the direction of the arrow R3 (clockwise direction) in the figure. The intermediate transfer belt 10 is wound around a plurality of supporting members: a secondary transfer opposing roller 13, a driving roller 11, and a tension roller 12.

On the inner peripheral surface side of the intermediate transfer belt 10, four primary transfer rollers 14 (14*a* to 14*d*) as primary transfer units are arranged side by side so as to face the photosensitive drums 1. The primary transfer roller 14 presses the intermediate transfer belt 10 against the photosensitive drum 1 to form a primary transfer portion where the intermediate transfer belt 10 and the photosensitive drum 1 are in contact with each other.

A secondary transfer roller 20 as a secondary transfer unit is disposed at a position facing the secondary transfer opposing roller 13 on the outer peripheral surface side of the intermediate transfer belt 10. The secondary transfer roller 20 is in pressure contact with the secondary transfer opposing roller 13 via the intermediate transfer belt 10 to form a secondary transfer portion where the intermediate transfer belt 10 and the secondary transfer roller 20 are in contact with each other.

The recording material P to which the toner image has been transferred is conveyed to a fixing device 30 as a fixing unit. By applying heat and pressure to the recording material P in the fixing device 30, the toner image is fixed to the recording material P.

The image forming apparatus 100 can form a monochromatic or multicolor image using only one desired image forming unit or using only some (not all) image forming units.

In this embodiment, the image forming apparatus 100 is a printer having a process speed of 100 mm/sec and compatible with A4 size recording paper.

Figure 3:
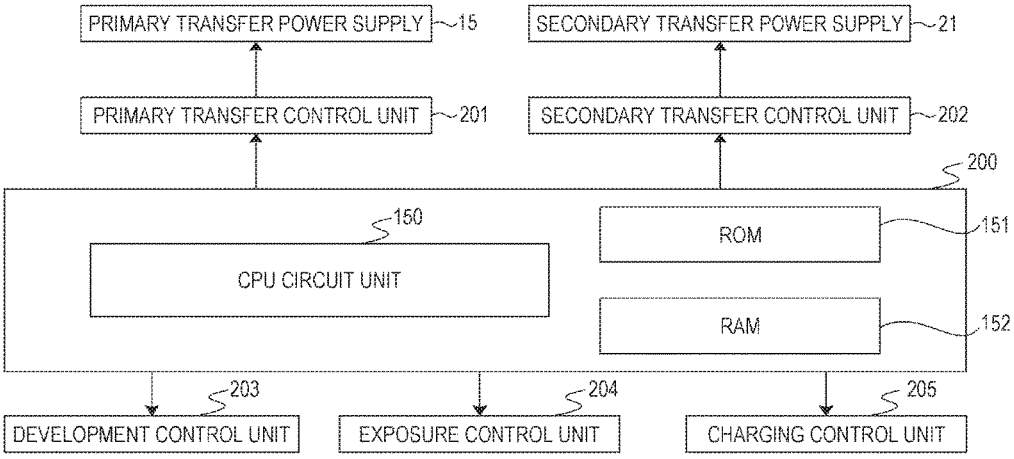
FIG. 3 is a control block diagram showing control of the image forming apparatus according to the first embodiment of the present disclosure.

Next, the configuration of a controller 200 that controls the entire image forming apparatus according to this embodiment will be described with reference to FIG. 3. FIG. 3 is a control block diagram showing control of the image forming apparatus according to the first embodiment of the present disclosure.

As shown in FIG. 3, the controller 200 incorporates a CPU circuit unit 150, a ROM 151, and a RAM 152. The CPU circuit unit 150 comprehensively controls a primary transfer control unit 201, a secondary transfer control unit 202, a development control unit 203, an exposure control unit 204, and a charging control unit 205 according to a control program stored in the ROM 151. A table corresponding to environmental information, paper thickness and the like is stored in the ROM 151, and called and reflected by the CPU. The RAM 152 temporarily stores control data, and is used as a work area for arithmetic processing involved in control.

The primary transfer control unit 201 and the secondary transfer control unit 202 control a primary transfer power supply 15 and a secondary transfer power supply 21, respectively, and control the voltage output from the primary transfer power supply 15 and the secondary transfer power supply 21 based on the current value detected by a current detection circuit (not shown). Upon receiving the image information and the print command from a host computer (not shown), the controller 200 controls the respective control units (the primary transfer control unit, the secondary transfer control unit, the development control unit, the exposure control unit, and the charging control unit) and performs the image forming operation necessary for the printing operation.

Electrophotographic Image Forming Process

Hereinafter, the functions of functional units constituting the image forming apparatus 100 of this embodiment and the image forming process will be described.

As shown in FIG. 2, at the time of image formation, the surface of the photosensitive drum 1 is first uniformly charged by the charging roller 2. Next, the charged surface of the photosensitive drum 1 is scanned and exposed with the laser light L emitted from the scanner unit 3 based on the output calculated by the CPU from the image information input from the host device, and an electrostatic image according to the image information is formed on the photosensitive drum 1. Next, the electrostatic image formed on the photosensitive drum 1 is developed as a toner image by the developing unit 4.

Then, a voltage having a polarity opposite to the normal charging polarity of the toner is applied to the primary transfer roller 14 from the primary transfer power supply 15 (high-voltage power supply) as a primary transfer voltage applying unit. As a result, the toner image on the photosensitive drum 1 is primarily transferred onto the intermediate transfer belt 10. At the time of forming a full-color image, the above-described process is sequentially performed in the first to fourth process cartridges Sa to Sd, and the toner images of respective colors are superimposed one upon another on the intermediate transfer belt 10 and primarily transferred.

Thereafter, in synchronization with the movement of the intermediate transfer belt 10, the recording material P is conveyed to the secondary transfer portion. Then, a voltage having a polarity opposite to the normal charging polarity of the toner is applied to the secondary transfer roller 20 from the secondary transfer power supply 21 (high voltage power supply) as a secondary transfer voltage applying unit. As a result, the four-color toner image on the intermediate transfer belt 10 is secondarily transferred collectively onto the recording material P conveyed by a feeding unit by the action of the secondary transfer roller 20 in contact with the intermediate transfer belt 10 via the recording material P.

The recording material P to which the toner image has been transferred is conveyed to a fixing device 30 as a fixing unit. In the fixing device 30, heat and pressure are applied to the recording material P, whereby the transferred toner image is fixed, and the recording material P is discharged from the image forming apparatus 100.

The primary transfer residual toner remaining on the photosensitive drum 1 after the primary transferring process is removed and recovered by the photosensitive drum cleaning device 5.

In the developing unit 4, a developing roller 22 (to be described later) as a developer bearing member is brought into contact with the photosensitive drum 1 to perform reversal development. That is, the developing unit 4 develops an electrostatic image by allowing, the toner charged to the same polarity as the charging polarity of the photosensitive drum 1 (negative polarity in this embodiment), to adhere to a portion on the photosensitive drum 1 where electric charge has been attenuated by the exposure (image portion, exposed portion).

Configuration of Process Cartridge

Next, the overall configuration of the process cartridge S installed in the image forming apparatus 100 of this embodiment will be described.

The process cartridges S for the respective colors have the same shape except for an identification unit (not shown) and the like.

Toners of respective colors of yellow (Y), magenta (M), cyan (C), and black (K) are accommodated in the developing units 4 of the process cartridges S for respective colors. In this embodiment, the developing unit 4 uses a nonmagnetic one-component toner as a developer.

The process cartridge S is formed by integrating a photosensitive unit having a photosensitive drum 1, a rotatable charging roller 2, and a photosensitive drum cleaning device 5, and a developing unit (developing device) 4 having a rotatable developing roller 22 (developer bearing member). The photosensitive drum cleaning device 5 has a photosensitive drum cleaning blade 6 arranged so as to contact the peripheral surface of the photosensitive drum 1.

The photosensitive drum 1 is supported by a bearing (not shown) rotatably relative to the photosensitive drum cleaning blade 6. By transmitting the driving force of a driving unit (driving source) (not shown) to the photosensitive unit, the photosensitive drum 1 is rotationally driven in the direction of the arrow RI (counterclockwise direction) in accordance with the image forming operation.

In the photosensitive drum cleaning device 5, the transfer residual toner removed from the surface of the photosensitive drum 1 by the photosensitive drum cleaning blade 6 drops and is accommodated in a cleaning frame. The charging roller 2 is configured such that a roller portion made of conductive rubber is in pressure contact with and driven to rotate by the photosensitive drum 1.

Figure 4:
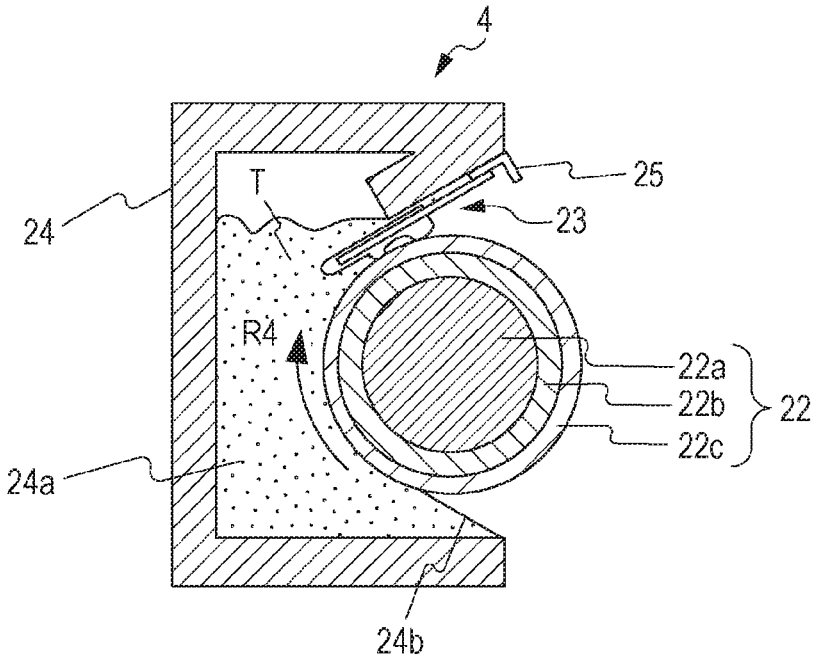
FIG. 4 is a conceptual cross-sectional view of the developing unit of the image forming apparatus according to the first embodiment of the present disclosure.

On the other hand, as shown in FIG. 4, the developing unit 4 mainly includes a developing roller 22 (developer bearing member) bearing toner T (developer), a developing blade 23 (regulating member), and a frame body 24 to which the developing roller 22 and the developing blade 23 are fixed. FIG. 4 is a conceptual cross-sectional view of the developing unit of the image forming apparatus according to this embodiment.

As shown in FIG. 4, the developing frame 24 includes a developing chamber 24*a* in which the developing roller 22 is disposed, and a blowout prevention sheet 24*b* for sealing a developing opening (opening) connected from the developing chamber 24*a* to the outside. One end of the developing blade 23 is fixed to a fixing member 25 fixed to the developing frame 24 and the other end of the developing blade 23 is brought into contact with the developing roller 22 so that regulation of the amount of toner coat on the developing roller 22 and charge application are possible.

The developing roller 22 is disposed in the developing opening and can be brought into contact with the photosensitive drum 1. The developing roller 22 is, for example, a roller having a configuration in which a base layer 22*b* made of silicon and a surface layer 22*c* made of urethane are sequentially laminated on a metal core 22*a*, and is arranged so as to be rotatable in a direction R4.

In this embodiment, the developing roller 22 and the photosensitive drum 1 are rotated such that the surfaces of the developing roller 22 and the photosensitive drum 1 move in the same direction (the direction from the upper side to the lower side in the gravitational direction in this embodiment) in the opposing portion. Then, a predetermined DC voltage is applied to the developing roller 22, and the electrostatic latent image on the photosensitive drum 1 is developed with the toner negatively charged by triboelectric charging, whereby a toner image is formed. In this embodiment, the developing roller 22 is disposed in contact with the photosensitive drum 1, but the developing roller 22 may be arranged close to the photosensitive drum 1 with a predetermined space therebetween.

Developing Blade (Regulating Member)

Figure 1A:
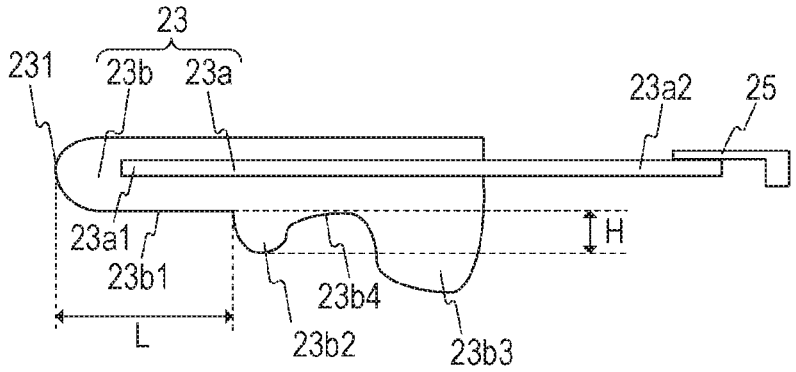
FIG. 1A is a conceptual cross-sectional view of the developing blade of the image forming apparatus according to the first embodiment of the present disclosure.

Next, the developing blade 23, which is the most important feature of the present disclosure, will be described in detail with reference to FIGS. 1A and 1B or FIG. 4. FIG. 1A is a conceptual cross-sectional view of the developing blade of the image forming apparatus according to the first embodiment, and FIG. 1B is a conceptual diagram showing the action of forces in the developing blade of the first embodiment.

Figure 1B:
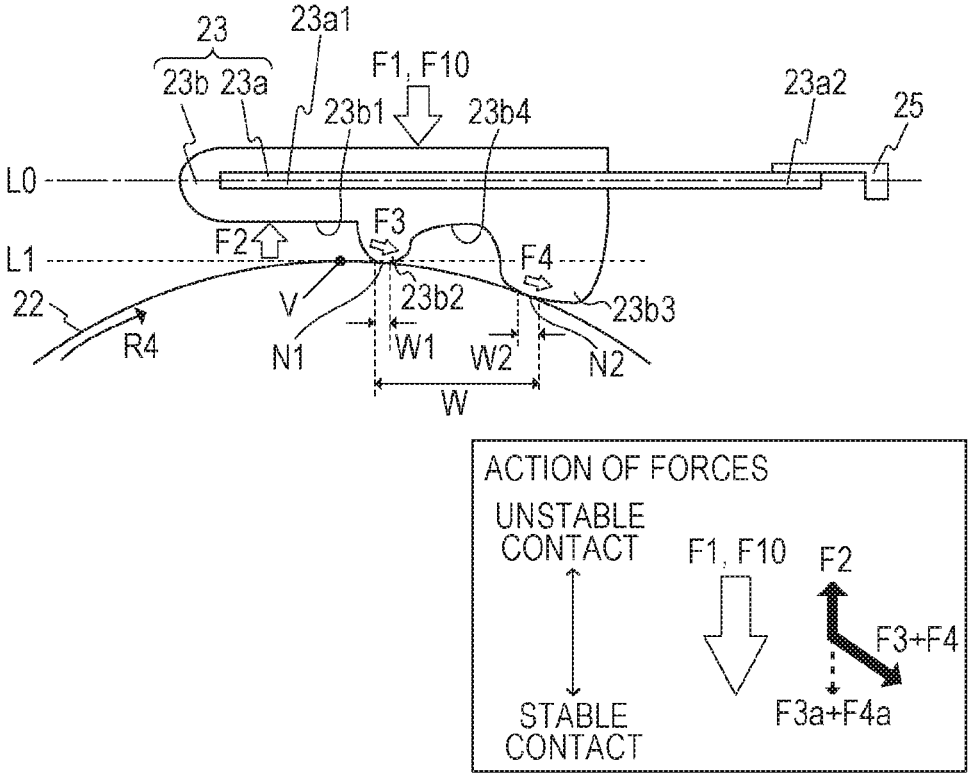
FIG. 1B is a conceptual diagram showing the action of forces in the developing blade of the first embodiment.

As shown in FIGS. 1A and 1B, the developing blade 23 includes a supporting member 23*a* (supporting portion) made mainly of a material having elasticity (spring property), and a contact member 23*b* (regulating portion) provided at the distal end (free end 23*al*) of the supporting member and having flexibility. By the contact member 23*b* of the developing blade, the thickness of the toner borne on the developing roller 22 is regulated, and the toner is triboelectrically charged. A fixed end 23*a*2 on the side opposite to the free end of the supporting member 23*a* is fixed to the developing frame 24 (see FIG. 4) via the fixing member 25.

Specifically, the developing blade 23 is disposed along the longitudinal direction of the developing roller 22, and includes a contact member 23*b* that contacts the developing roller 22 and is elastically deformable, and a supporting member 23*a* supporting the contact member and supported by a developing frame 24 (developing container). The developing frame 24 accommodates toner to be borne by the developing roller 22 and rotatably supports the developing roller 22. The free end of the supporting member 23*a* is arranged so as to extend from the fixed end fixed to the developing frame 24 to the upstream side in the rotation direction R4 of the developing roller 22.

As shown in FIGS. 1A and 1B, the contact member 23*b* includes a first contact portion 23*b*2 that contacts the developing roller 22 and a second contact portion 23*b*3 that contacts the developing roller 22 on the downstream side of the first contact portion in the rotation direction R4 of the developing roller 22.

The contact member 23*b* further includes a first opposed surface portion 23*b*1 that is apart from and opposed to the developing roller on the upstream side of the first contact portion 23*b*2 in the rotation direction R4 of the developing roller 22. The contact member 23*b* further includes a second opposed surface portion 23*b*4 that is apart from and opposed to the developing roller on the downstream side of the first contact portion 23*b*2 and on the upstream side of the second contact portion 23*b*3 in the rotation direction R4. That is, in this embodiment, the contact member 23*b* includes two contact portions (23*b*2 and 23*b*3) whose contact surfaces with the developing roller 22 are not continuous in the rotation direction R4.

As shown in FIG. 1B, when, in a plane orthogonal to the rotation axis direction of the developing roller 22, the fixed end (the fixing member 25 side) and the free end (the distal end side) of the supporting member 23*a* are connected by an imaginary straight line L0, a tangent line L1 tangent to the outer periphery of the developing roller 22 and parallel to the imaginary straight line L0 is obtained. The contact position (N1) where the first contact portion 23*b*2 contacts the developing roller 22 is located on the downstream side, in the rotation direction R4 of the developing roller, of the contact point V through which the tangent line L1 passes. The contact position (N2) of the second contact portion 23*b*3 is located on the downstream side, in the rotation direction R4, of the contact position (N1) of the first contact portion 23*b*2.

As will be described later, due to the elasticity of the supporting member 23*a*, a force (pressure) F1 toward the development roller 22 side is generated in the contact member 23*b* provided at the free end of the supporting member 23*a*. On the other hand, when the developing roller 22 rotates in the direction R4, a force (pressure/particle pressure) F2 in a direction in which the contact member 23*b* separates from the developing roller 22 is also generated due to the flow of the toner.

In addition, forces (frictional forces) F3 and F4 are generated at the contact positions (N1 and N2) of the first contact portion 23*b*2 and the second contact portion 23*b*3 with the developing roller 22. As a result, the actual contact pressure F10 at the contact positions (N1 and N2) is determined by the resultant force of the forces F1 to F4.

In this embodiment, the contact width W2 of the second contact portion 23*b*3 with the developing roller 22 can be made larger than the contact width W of the first contact portion 23*b*2 with the developing roller 22. That is, as shown in FIG. 1B, as the distance from the contact point V toward the downstream side in the rotation direction increases, the force component (component force) heading downward in the figure (toward the developing roller 22) increases (F4*a*>F3*a*). Therefore, by making the contact width W2 of the second contact portion 23*b*3 larger than the contact width W1 of the first contact portion 23*b*2, the contact pressure F10 can be generated more effectively.

In this embodiment, in the developing blade 23, a leaf spring-like SUS plate having a thickness of 50 to 120 μm is used as the supporting member 23*a*, and the surface of the contact member 23*b* is brought into contact with the developing roller 22 by utilizing the spring elasticity of the supporting member 23*a*.

The developing blade 23 is not limited to the above configuration, and not only an SUS plate but also a metal thin plate (metal material), for example, of phosphor bronze or aluminum may be used as the supporting member 23*a*.

On the other hand, the contact member 23*b* may be made of a conductive rubber. For example, the contact member 23*b* can be formed by coating the surface of the supporting member 23*a* with a thin film made of a conductive resin made of polyamide elastomer, urethane rubber, urethane resin, or the like.

In the first contact portion 23*b*2 and the second contact portion 23*b*3, contact nip portions N1 and N2 that contact the developing roller 22 are formed, respectively. The contact nip portions N1 and N2 are formed on the downstream side, in the rotation direction of the developing roller 22, of a part of the developing roller 22 that is closest to the supporting member 23*a* (contact point V).

In the contact nip portions N1 and N2, due to the rotation of the developing roller 22, the toner is triboelectrically charged by friction between the developing roller 22 and the developing blade 23, and charge is applied to the toner. At the same time, the layer thickness of the toner T on the developing roller 22 is regulated by the contact member 23*b*, and the layer thickness is regulated so as to be uniform. In this embodiment, when the contact member 23*b* is brought into contact with the developing roller 22 with a contact pressure F1=50 gf/cm, the contact widths (nip widths) W1 and W2 between the first and second contact portions (23*b*2 and 23*b*3) and the developing roller 22 are both 300 to 600 μm.

In this embodiment, the first opposed surface portion 23*b*1 is configured so as to be substantially parallel to the supporting member 23*a* in the widthwise direction.

Action of Forces

Next, the principle of the action of forces of this embodiment will be described in detail.

As shown in FIG. 1B, due to the rotation of the developing roller 22, the toner is supplied to the (opposed) space between the developing roller 22 and the first opposed surface portion 23*b*1. As a result, the pressure F2 from the toner is applied in a direction normal to the first opposed surface portion 23*b*1. Therefore, the developing blade 23 is pushed up in a direction away from the developing roller 22, and the force F2 acts in a direction in which the contact pressure F10 decreases.

On the other hand, since the developing blade 23 is in contact with the developing roller 22 at a plurality of places (the first contact portion 23*b*2 and the second contact portion 23*b*3), in the nip portions N1 and N2, frictional forces F3 and F4 are generated in the developing blade 23. Since the frictional forces F3 and F4 act on the downstream side of the contact point V in the rotation direction of the developing roller 22, the normal components F3*a* and F4*a* of the frictional forces F3 and F4 are generated in a direction normal to the first opposed surface portion 23*b*1.

At this time, since the normal components F3*a* and F4*a* act in the direction opposite to the force F2 in the direction of decreasing the contact pressure F1, as a result, the force in the direction in which the developing blade 23 is pushed up in a direction away from the developing roller 22 can be decreased (cancelled). As a result, a proper contact pressure F10 is applied between the developing blade 23 and the developing roller 22, and predetermined contact widths W1 and W2 can be obtained.

By the above action of forces, the decrease in the contact pressure and the contact width between the developing blade 23 and the developing roller 22 can be effectively suppressed. As a result, failure in regulation of the toner layer by the developing blade 23 can be suppressed, and an image defect caused by occurrence of "fogging" where the toner adheres to the non-image forming portion can be suppressed.

When the radius of the developing roller 22 is X (mm) and the distance between the first contact portion 23*b*2 and the second contact portion 23*b*3 (the distance between the nip portions N1 and N2) is W, W=(0.30±0.15)×X (mm).

As a result, frictional forces F3 and F4 are generated in the first contact portion 23*b*2 and the second contact portion 23*b*3 arranged on the downstream side, in the rotation direction of the developing roller 22, of the contact point V of the developing roller 22. F3*a* and F4*a*, which are components of the frictional forces F3 and F4 normal to the first opposed surface portion 23*b*1 against the pressure F2 of the toner acting on the first opposed surface portion 23*b*1, effectively act, and the contact pressure F10 of the developing blade 23 can be stabilized.

In this embodiment, when the distance from the distal end surface 231 of the contact member 23*b* on the free end side of the supporting member 23*a* to the first contact portion 23*b*2 (the position closest to the distal end surface) is L, it is preferable that 0.85 mm≤L≤2.00 mm.

When the distance L is 0.85 mm or less, the width of the first opposed surface portion 23*b*1 located on the upstream side of the first contact portion 23*b*2 is small, and the force pulling the toner into the contact portion is likely to decrease, and as a result, the chargeability to the toner is likely to decrease. On the other hand, when the distance L is 2.00 mm or more, the width of the first opposed surface portion 23*b*1 located on the upstream side of the first contact portion 23*b*2 is large, and as the amount of toner entering between the opposed surface portion and the developing roller increases, a force pushing up the developing blade 23 is likely to be generated. Also in this case, the contact pressure at the contact portion is likely to decrease, and as a result, there is a high possibility of causing regulation failure and charging failure.

When the height (maximum height) of the first contact portion 23*b*2 relative to the first opposed surface portion 23*b*1 is H, it is preferable that 0.1 mm≤H≤0.3 mm.

When the height H is 0.1 mm or less, the force pulling the toner into the first contact portion 23*b*2 is likely to decrease, and as a result, the chargeability to the toner is likely to decrease. On the other hand, when the height H is 0.3 mm or more, as the amount of toner entering between the opposed surface portion and the developing roller increases, a force pushing up the developing blade 23 is likely to be generated. Also in this case, the contact pressure at the contact portion is likely to decrease, and as a result, there is a high possibility of causing regulation failure and charging failure.

In particular, conventionally, in the toner T, the charge amount of each toner particle is sometimes uneven. This is presumably because the toner T is roughly divided into three types of toner particles.

That is, the first type is toner particles T1 that contacted the developing roller 22 and received electric charge. The second type is toner particles T2 that do not contact the developing roller 22 and do not receive electric charge. The third type is toner particles T3 that did not directly contact the developing roller 22 but contacted the toner particles T1, which contacted the developing roller 22 and received electric charge, and indirectly received electric charge from the toner particles T1.

Thus, the toner T has toner particles T1, T2, and T3 with different amounts of charge received from the developing roller 22. Therefore, when the electrostatic latent image on the photosensitive drum 1 is developed, the toner density in the image forming portion can decrease, or fogging can occur in which the toner adheres to the non-image forming portion, and an image defect can thereby occur.

In this embodiment, as described above, by defining the "distance L" and the "height H", the toner particles T1, T2, and T3 can be brought into contact with each other better between the developing roller 22 and the first opposed surface portion 23*b*1. Thereby, the charge amount of each toner particle of the toner T can be averaged, and occurrence of an image defect such as fogging can be suppressed.

Further, in this embodiment, since the developing roller 22 and the developing blade 23 are in contact with each other at the plurality of contact nip portions N1 and N2, the toner T can have an opportunity for triboelectric charging at each of the contact nip portions N1 and N2. As a result, the average value of the charge amount of each toner particle of the toner T can be increased, and a better image can be provided.

In this embodiment, two contact portions are provided to generate the frictional force F, but three or more contact portions may be provided to form three or more nip portions N on the downstream side of a part of the developing roller 22 that is closest to the supporting member 23*a* (contact point V).

Experimental Result

The effect of this embodiment can be confirmed by the following method.

A paper passing experiment was conducted in which the recording operation was performed on the recording material P (recording paper) by using the image forming apparatus 100. The paper passing experiment was conducted for 2000 sheets intermittently two sheets at a time in each of a low temperature and low humidity environment (15° C./10%), a normal temperature and normal humidity environment (23° C./50%), and a high temperature and high humidity environment (30° C./80%).

In the configuration of the first embodiment and the configurations of first and second comparative examples, verification was carried out through the above paper passing experiment as to the presence or absence of the occurrence of an image defect such as regulation failure, the presence or absence of the occurrence of fogging, and the like.

First Comparative Example

Figure 5A:
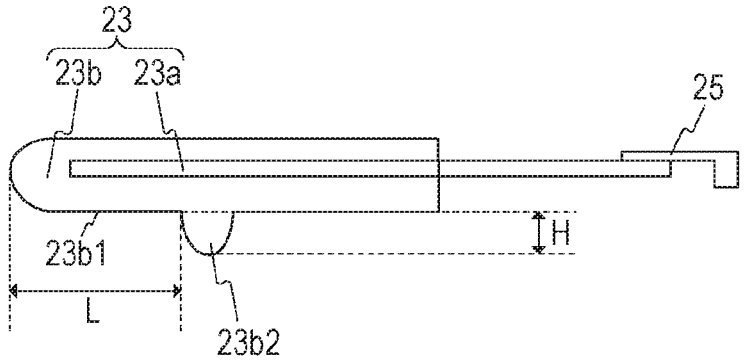
FIG. 5A is a cross-sectional view of the developing blade according to the first comparative example of the first example of the present disclosure.
Figure 5B:
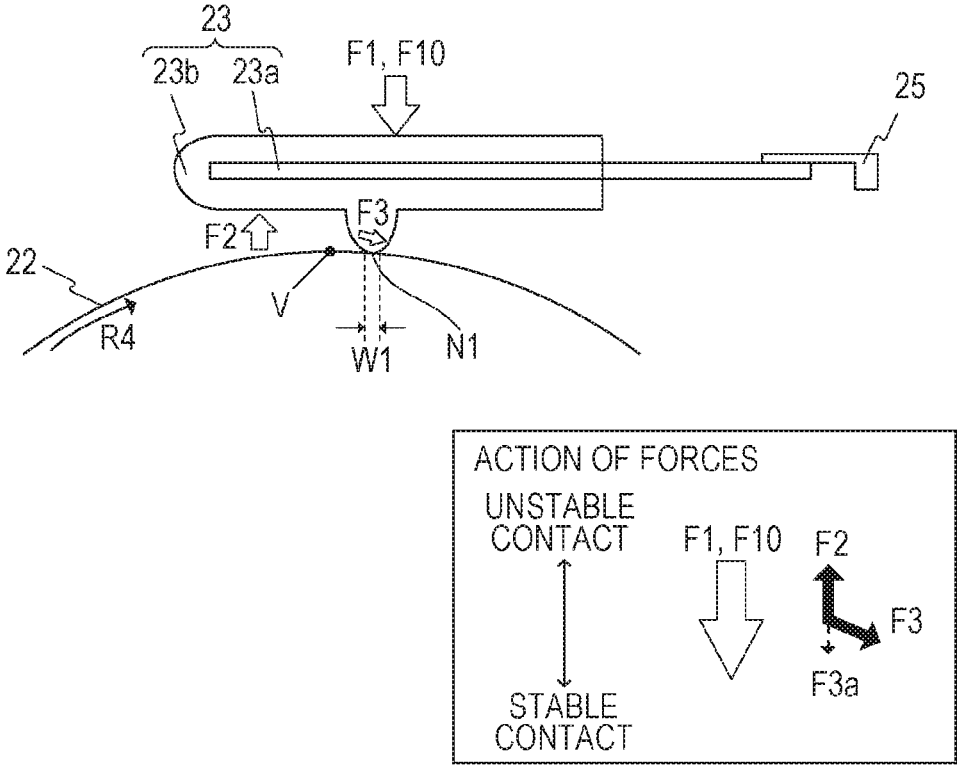
FIG. 5B is a conceptual diagram showing the action of forces in the developing blade of the first comparative example.

FIG. 5A is a cross-sectional view of the developing blade according to the first comparative example of the first embodiment, and FIG. 5B is a conceptual diagram showing the action of forces in the developing blade of the first comparative example.

As shown in FIG. 5A, the contact member 23*b* of the first comparative example includes, in order from the downstream side in the rotation direction of the developing roller 22, a first contact portion 23*b*2 and a first opposed surface portion 23*b*1. The first contact portion 23*b*2 is arranged so as to protrude toward the developing roller 22 and contact the developing roller 22. On the other hand, the first opposed surface portion is arranged such that one end thereof is connected to the first contact portion 23*b*2 and the other end thereof is a free end and is opposed to the developing roller 22.

In the first contact portion 23*b*2, a contact nip portion N1 that contacts the developing roller 22 is formed. The contact nip portion N is formed on the downstream side, in the rotation direction of the developing roller 22, of a part of the developing roller 22 that is closest to the supporting member 23*a* (contact point V).

At the contact nip portion N1, due to the rotation of the developing roller 22, toner is triboelectrically charged by friction with the developing roller 22, charge is applied to the toner, and at the same time, the layer thickness of the toner T on the developing roller 22 is regulated so as to be uniform.

In the first comparative example, when the contact member 23*b* is brought into contact with the developing roller 22 with a contact pressure F1=50 gf/cm, the contact width (nip width) W1 between the contact member 23*b* and the developing roller 22 was 300 to 600 μm.

Second Comparative Example

Figure 6A:
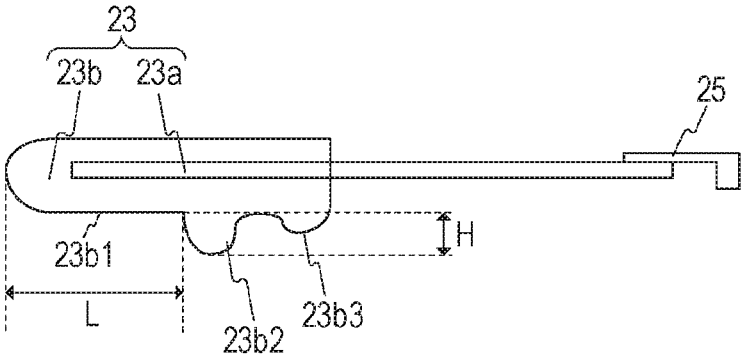
FIG. 6A is a cross-sectional view of the developing blade according to the second comparative example of the first example of the present disclosure.
Figure 6B:
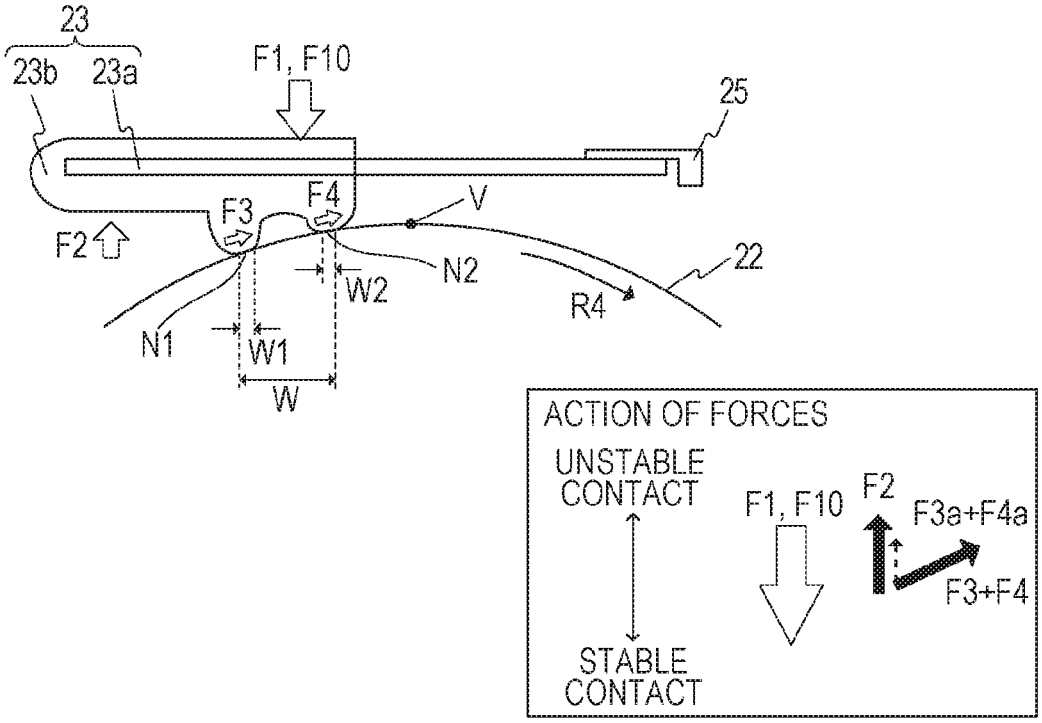
FIG. 6B is a conceptual diagram showing the action of forces in the developing blade of the second comparative example.

FIG. 6A is a cross-sectional view of the developing blade according to the second comparative example of the first embodiment, and FIG. 6B is a conceptual diagram showing the action of forces in the developing blade of the second comparative example.

As shown in FIG. 6A, the contact member 23*b* of the second comparative example includes, in order from the downstream side in the rotation direction of the developing roller 22, a second contact portion 23*b*3 and a first contact portion 23*b*2 that protrude toward and contact the developing roller 22, and a first opposed surface portion 23*b*1. The first opposed surface portion 23*b*1 is arranged such that one end thereof is connected to the first contact portion 23*b*2 and the other end thereof is a free end and is opposed to the developing roller 22.

In the first contact portion 23*b*2 and the second contact portion 23*b*3, contact nip portions N1 and N2 that contact the developing roller 22 are formed. The contact nip portions N1 and N2 are formed on the upstream side, in the rotation direction of the developing roller 22, of a part of the developing roller 22 that is closest to the supporting member 23*a* (contact point V).

The conditions such as the contact pressure to bring the contact member 23*b* into contact with the developing roller 22 and the contact widths (nip widths) W1 and W2 between the first contact portion 23*b*2, the second contact portion 23*b*3 and the developing roller 22 are the same as the conditions of the first embodiment.

Table 1 shows experimental results of paper passing experiments on the presence or absence of the occurrence of an image defect and fogging in the first embodiment, the first comparative example and the second comparative example.

TABLE 1

| | Low temperature and low humidity environment | | Normal temperature and normal humidity environment | | High temperature and high humidity environment | |
|---|---|---|---|---|---|---|
| | Regulation failure | Fogging | Regulation failure | Fogging | Regulation failure | Fogging |
| First embodiment | Good | Good | Good | Good | Good | Good |
| First comparative example | Poor | Good | Good | Good | Good | Poor |
| Second comparative example | Poor | Good | Poor | Good | Good | Good |

In Table 1, "good" means that there is no occurrence of regulation failure (image defect) or fogging (abnormal development of toner). On the other hand, "poor" means that the toner layer cannot be regulated due to a decrease in the contact pressure, and toner of a desired amount or more is transferred onto the recording paper, and occurrence of regulation failure and fogging is confirmed.

As shown in Table 1, in the configuration of the first embodiment, the frictional forces F3 and F4 were able to be effectively exerted against the toner particle pressure F2 applied to the first opposed surface portion 23*b*1, in the direction of stabilizing the contact between the developing roller 22 and the developing blade 23. For this reason, no image defect occurred in each environment. Furthermore, by providing a plurality of contact places (contact portions), triboelectric charging of the toner was improved, and a fine image was maintained even in a high temperature and high humidity environment where the toner chargeability tends to be low.

On the other hand, in the configuration of the first comparative example, only the frictional force F3 acts against the toner particle pressure F2 applied to the first opposed surface portion 23*b*1, in the direction of stabilizing the contact between the developing roller 22 and the developing blade 23. For this reason, in the low temperature and low humidity environment, regulation failure occurred due to a decrease in the contact pressure. In addition, in the first comparative example, since there was only one contact place, fogging occurred frequently in the high-temperature and high-humidity environment where there are few opportunities for triboelectric charging and toner chargeability tends to be low.

In the configuration of the second comparative example, since the triboelectric charging of the toner was improved by providing a plurality of contact portions, fogging was small in either environment. However, for the toner particle pressure F2 in the first opposed surface portion 23*b*1, the frictional forces F3 and F4 between the developing roller 22 and the developing blade 23 act in a direction away from the contact direction. For this reason, as compared with the first embodiment and the first comparative example, the contact was weak, and regulation failure occurred not only in the low temperature and low humidity environment but also in the normal temperature and normal humidity environment.

As described above, there is a case where the toner enters the (wedge-shaped) space between the developing blade 23 and the developing roller 22, and the toner particle pressure F2 trying to deform the developing blade 23 in a direction away from the outer peripheral surface of the developing roller 22 is applied. According to the configuration of this embodiment, even in such a case, the contact state can be stabilized between the developing blade 23 and the developing roller 22 by a plurality of frictional forces against the toner particle pressure, and therefore regulation failure of the toner layer can be suppressed and occurrence of an image defect can be reduced.

Other

In this embodiment, one end (fixed end) on the side opposite to the distal end (free end) of the supporting member 23*a* is fixed to the developing frame 24 (see FIG. 4) via the fixing member 25. However, the fixed end of the supporting member 23*a* may be directly fixed to the developing frame 24.

In this embodiment, the contact member 23*b* has two contact portions: the first contact portion 23*b*2 and the second contact portion 23*b*3, but the number of contact portions that contact the developing roller 22 may be three or more. In this case, the first contact portion 23*b*2 is preferably located on the most upstream side of all the contact portions in the rotation direction R4 of the developing roller 22. Some of the plurality of contact portions may be arranged on the upstream side, in the rotation direction R4, of the contact point V as long as the force F2 pushing up the developing blade can be cancelled.

The developing device of the present disclosure may be configured to be detachably attachable to the main body of an image forming apparatus that forms an image.

The process cartridge of the present disclosure may include an image bearing member on which an electrostatic latent image is formed and the above-described developing unit (developing device) for developing an electrostatic latent image formed on the image bearing member, and may be detachably attachable to the apparatus body of an image forming apparatus.

The image forming apparatus of the present disclosure may be configured to include a developing unit (developing device) for developing an electrostatic latent image formed on the above-described image bearing member, and a fixing device (fixing portion). The image forming apparatus of the present disclosure may be configured to include a process cartridge including the above-described developing unit (developing device) and a fixing device (fixing unit).

Second Embodiment

A second embodiment of the present disclosure basically has the same configuration as the first embodiment, and different points will be mainly described with reference to FIGS. 7A and 7B.

Figure 7A:
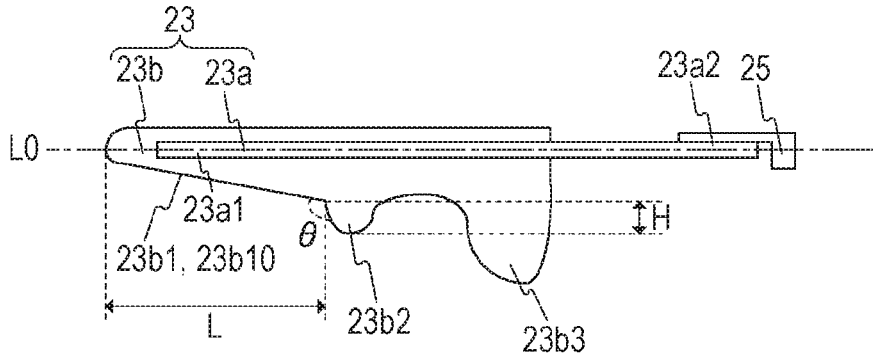
FIG. 7A is a conceptual cross-sectional view of the developing blade of the image forming apparatus according to the second embodiment of the present disclosure.
Figure 7B:
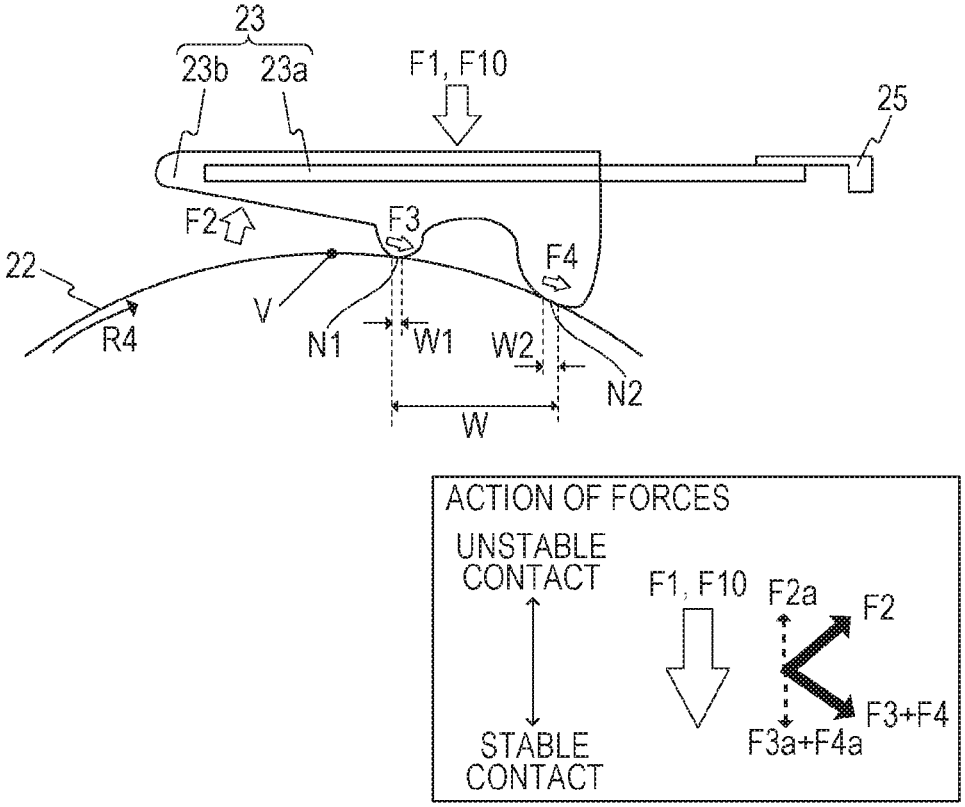
FIG. 7B is a conceptual diagram showing the action of forces in the developing blade of the second embodiment.

FIG. 7A is a conceptual cross-sectional view of the developing blade of the image forming apparatus according to the second embodiment of the present disclosure, and FIG. 7B is a conceptual diagram showing the action of forces in the developing blade of the second embodiment.

In the first embodiment, the first opposed surface portion 23*b*1 of the contact member 23*b* is substantially parallel to the imaginary straight line L0, whereas in the second embodiment, as shown in FIG. 7A, the first opposed surface portion 23*b*1 is formed to be inclined with respect to the imaginary straight line L0.

Specifically, the contact member 23*b* has a first opposed surface portion 23*b*1 opposed to the developing roller 22 via a predetermined space and having an inclined surface 23*b*10 inclined with respect to the imaginary straight line L0.

Also in this embodiment, the contact member 23*b* includes, in order from the downstream side in the rotation direction of the developing roller 22, a second contact portion 23*b*3 and a first contact portion 23*b*2 that protrude toward and contact the developing roller 22, and the first opposed surface portion 23*b*1. Contact nip portions N1 and N2 are formed between the first contact portion 23*b*2, the second contact portion 23*b*3 and the developing roller 22. The contact nip portions N1 and N2 are formed on the downstream side, in the rotation direction of the developing roller 22, of a part of the developing roller 22 that is closest to the supporting member 23*a* (contact point V).

In this embodiment, as shown in FIG. 7A, the inclined surface 23*b*10 is formed such that the angle θ formed by the first contact portion 23*b*2 and the first opposed surface portion 23*b*1 is an obtuse angle (>90°).

As described above, in this embodiment, the first opposed surface portion can have the inclined surface 23*b*10 inclined with respect to the imaginary straight line L0. The inclined surface 23*b*10 may be inclined so as to become apart from the imaginary straight line L0 with a direction toward the downstream side from the upstream side in the rotation direction R4 of the developing roller.

Action of Forces

Next, the principle of the action of forces of this embodiment will be described.

As shown in FIG. 7B, due to the rotation of the developing roller 22, the toner is supplied between the developing roller 22 and the first opposed surface portion 23*b*1, and a pressure F2 from the toner is generated in a direction normal to the first opposed surface portion 23*b*1. In this embodiment, by providing the first opposed surface portion 23*b*1 with the inclined surface 23*b*10, a part of the pressure F2 from the toner can be released in a direction parallel to the supporting member 23*a*.

As a result, the component F2*a* normal to the supporting member 23*a*, of the force F2 in opposition to the force F1 in the contact direction of the developing blade 23 (F2*a*<F2) can be reduced, and the pushing-up of the developing blade can be further suppressed. As a result, also due to the action of frictional forces F3 and F4, a proper contact pressure F10 is applied between the developing blade 23 and the developing roller 22, so that predetermined contact widths W1 and W2 can be formed.

By the action of the above forces, a decrease in the contact pressure and the contact width between the developing blade 23 and the developing roller 22 can be suppressed. As a result, the occurrence of failure in regulation of the toner layer by the developing blade 23 and an image defect such as occurrence of fogging can be suppressed.

When a predetermined voltage is applied from a blade power supply (not shown) to the developing blade 23, the frictional forces F3 and F4 are increased by the electrostatic attraction force between the developing roller 22 and the first contact portion 23*b*2 and the second contact portion 23*b*3 of the developing blade 23. As a result, the above-described action of forces works more effectively, and the contact pressure F10 of the developing blade 23 can be stabilized.

Third Embodiment

A third embodiment of the present disclosure basically has the same structure as the first embodiment, and different points will be mainly described with reference to FIGS. 8A, 8B, and 9.

Figure 8A:
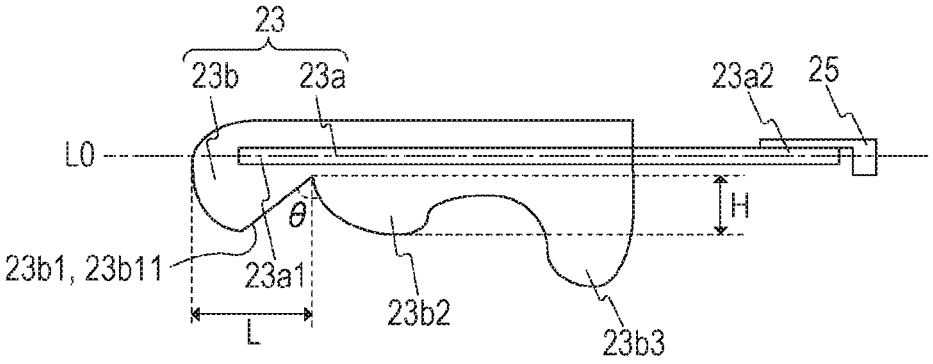
FIG. 8A is a conceptual cross-sectional view of the developing blade of the image forming apparatus according to the third embodiment of the present disclosure.
Figure 8B:
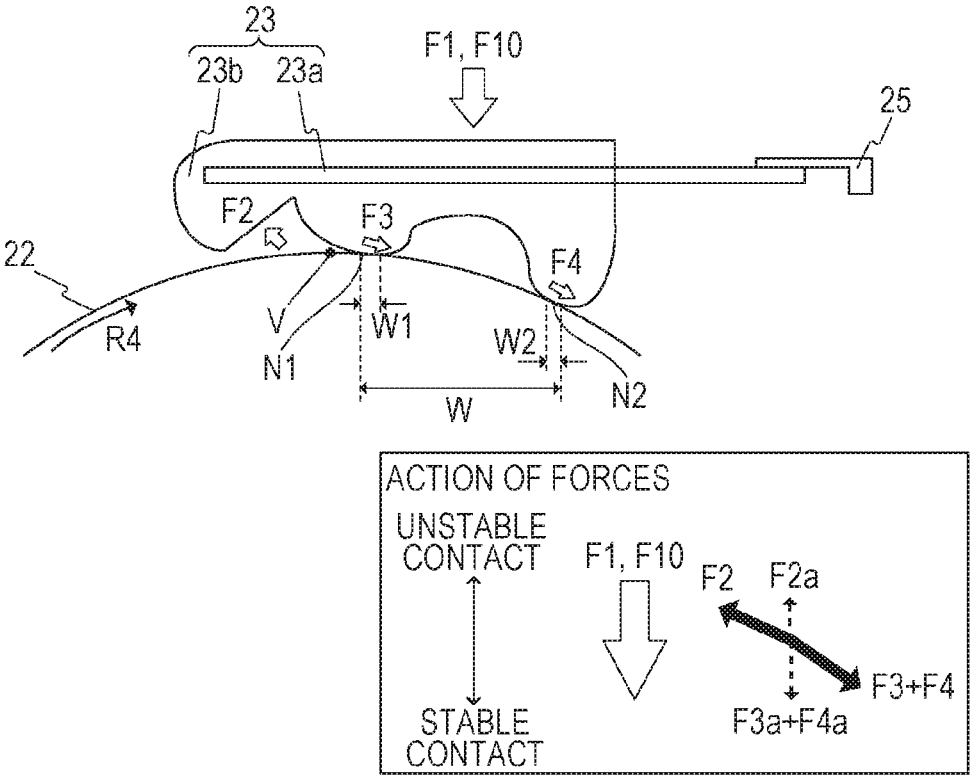
FIG. 8B is a conceptual diagram showing the action of forces in the developing blade of the third embodiment.

FIG. 8A is a conceptual cross-sectional view of the developing blade of the image forming apparatus according to the third embodiment of the present disclosure, and FIG. 8B is a conceptual diagram showing the action of forces in the developing blade of the third embodiment. FIG. 9 is a conceptual diagram showing the action of forces in the developing blade of the image forming apparatus according to the third embodiment of the present disclosure.

In this embodiment, as shown in FIG. 8A, the first opposed surface portion 23*b*1 of the contact member 23*b* has an inclined surface 23*b*11 inclined with respect to the imaginary straight line L0. By setting the inclination angle of the inclined surface 23*b*11, that is, the angle θ formed by the first opposed surface portion 23*b*1 and the first contact portion 23*b*2 at an acute angle (<90°), new action of forces to be described later can be obtained.

Also in this embodiment, the contact member 23*b* includes, in order from the downstream side in the rotation direction of the developing roller 22, a second contact portion 23*b*3, a first contact portion 23*b*2, and a first opposed surface portion 23*b*1. Contact nip portions N1 and N2 are formed between the first contact portion 23*b*2, the second contact portion 23*b*3 and the developing roller 22. The contact nip portions N1 and N2 are formed on the downstream side, in the rotation direction of the developing roller 22, of a part of the developing roller 22 that is closest to the supporting member 23*a* (contact point V).

As described above, in this embodiment, the inclined surface 23*b*11 may be inclined so as to become closer to the imaginary straight line L0 with a direction toward the downstream side from the upstream side in the rotation direction R4 of the developing roller 22. In particular, when viewed along the rotation direction R4 of the developing roller 22, it is preferable that the angle θ formed between the inclined surface 23*b*11 and the first contact portion 23*b*2 is an acute angle.

Action of Forces

Next, the principle of the action of forces of this embodiment will be described.

Figure 9:
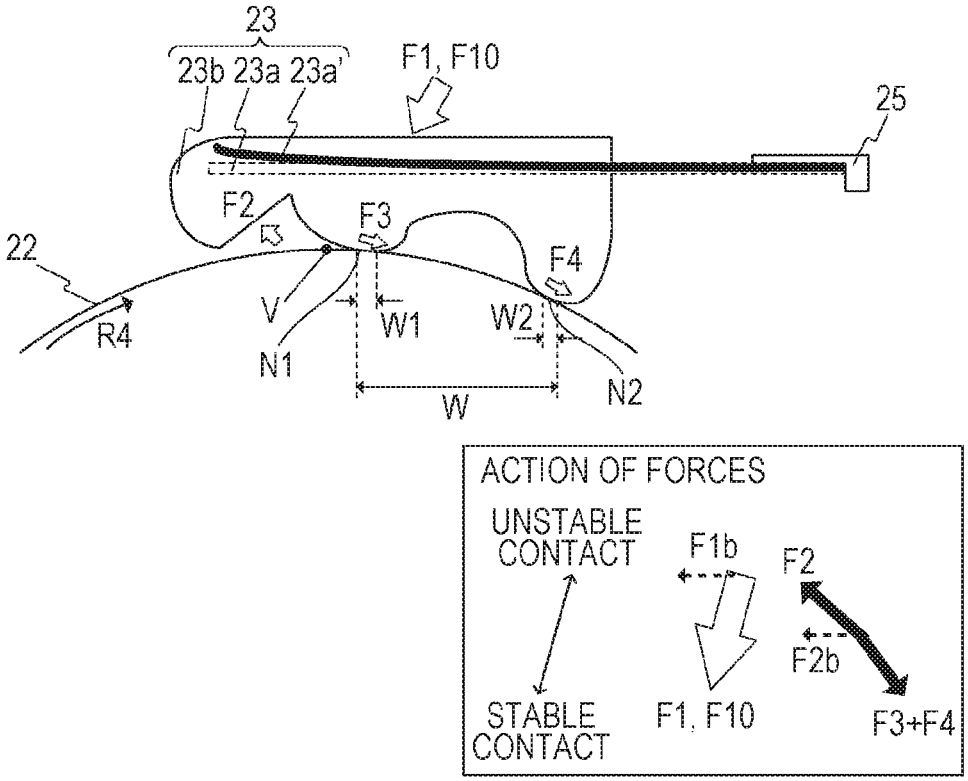
FIG. 9 is a conceptual diagram showing the action of forces in the developing blade of the image forming apparatus according to the third embodiment of the present disclosure.

As shown in FIG. 8B or FIG. 9, also in the configuration of the third embodiment, the effect relating to the frictional forces F3 and F4 acting on the first contact portion 23*b*2, the second contact portion 23*b*3 and the developing roller 22, and the effect of releasing a part of the toner pressure F2 in a direction parallel to the supporting member 23*a* are the same as in the second embodiment.

The specific action of forces of the third embodiment will be described with reference to FIG. 9.

As shown in FIG. 9, when the developing blade 23 is strongly brought into contact with the developing roller 22, the supporting member 23*a* (23*a*) can be deformed so as to bend. At this time, in the contact pressure F1, a horizontal component F1*b* which does not exist in the first and second embodiments is included (generated).

At this time, by setting the angle formed by the first opposed surface portion 23*b*1 and the first contact portion 23*b*2 to an acute angle (<90°), horizontal component force F2*b* of the toner pressure F2 can be added to the horizontal component F1*b* of the contact pressure F1.

As a result, the horizontal component force of the supporting member 23*a* is strengthened, and the developing blade 23 can stably contact the developing roller 22. As described above, the developing blade 23 can stably contact the developing roller 22, a proper contact pressure F10 is applied between the developing blade 23 and the developing roller 22, and predetermined contact widths W1 and W2 can be formed.

According to the developing device, the process cartridge or the image forming apparatus of the present disclosure, it is possible to suppress a decrease in the contact pressure of a regulating member with a developer bearing member while improving the amount of toner taken into a contact portion.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-191931 filed Sep. 29, 2017, which is hereby incorporated by reference herein in its entirety.

What is claimed is:

1. A developing device comprising:

a developer bearing member configured to bear developer;

a developing flame configured to accommodate developer to be borne by the developer bearing member and rotatably support the developer bearing member;

a supporting portion including a fixed end fixed to the developing frame and a free end extending from the fixed end to the upstream side in the rotation direction of the developer bearing member; and a regulating portion provided at the free end of the supporting portion and configured to regulate the thickness of the developer borne on the developer bearing member by contacting with the developer bearing member, wherein the regulating portion includes a first contact portion contacting the developer bearing member, a second contact portion contacting the developer bearing member on the downstream side of the first contact portion in the rotation direction of the developer bearing member, a first opposed surface portion apart from and opposed to the developer bearing member on the upstream side of the first contact portion in the rotation direction of the developer bearing member, and a second opposed surface portion apart from and opposed to the developer bearing member on the downstream side of the first contact portion and on the upstream side of the second contact portion in the rotation direction of the developer bearing member, and wherein when, in a plane orthogonal to the rotation axis direction of the developer bearing member, the fixed end and the free end of the supporting member are connected by an imaginary straight line, a contact position where the first contact portion contacts the developer bearing member is located on the downstream side, in the rotation direction of the developer bearing member, of a point of contact of a tangent line parallel to the imaginary straight line with the outer periphery of the developer bearing member.

2. The developing device according to claim 1, wherein the regulating portion includes three or more contact portions including the first contact portion and the second contact portion and contacting the developer bearing member, and wherein the first contact portion is located at the most upstream side of all the three or more contact portions in the rotation direction of the developer bearing member.

3. The developing device according to claim 1, wherein the first opposed surface portion has an inclined surface inclined with respect to the imaginary straight line.

4. The developing device according to claim 3, wherein the inclined surface is inclined so as to become apart from the imaginary straight line with a direction toward the downstream side from the upstream side in the rotation direction of the developer bearing member.

5. The developing device according to claim 3, wherein the inclined surface is inclined so as to become closer to the imaginary straight line with a direction toward the downstream side from the upstream side in the rotation direction of the developer bearing member.

6. The developing device according to claim 5, wherein when viewed along the rotation axis direction of the developer bearing member, an angle formed between the inclined surface and the first contact portion is an acute angle.

7. The developing device according to claim 1, wherein the contact width between the developer bearing member and the second contact portion is larger than the contact width between the developer bearing member and the first contact portion.

8. The developing device according to claim 1, wherein $$W=(0.30\pm0.15)X,$$

where X is the radius of the developer bearing member and W is the distance between the first contact portion and the second contact portion.

9. The developing device according to claim 1, wherein $$0.85\ \text{mm}\leq L\leq 2.00\ \text{mm},$$

where L is the distance from the distal end surface of the regulating portion on the free end side of the supporting portion to the first contact portion.

10. The developing device according to claim 1, wherein $$0.1\ \text{mm}\leq H\leq 0.3\ \text{mm},$$

where H is the height of the first contact portion relative to the first opposed surface portion.

11. The developing device according to claim 1, wherein the regulating portion is formed of a metal material.

12. The developing device according to claim 1, wherein the regulating portion is formed of conductive rubber.

13. The developing device according to claim 1, wherein the developing device is configured to be detachably attachable to a main body of an image forming apparatus configured to form an image.

14. A process cartridge comprising:

an image bearing member on which an electrostatic latent image is formed; and the developing device according to claim 1 configured to develop the electrostatic latent image formed on the image bearing member, and the process cartridge being detachably attachable to a main body of an image forming apparatus.

15. An image forming apparatus comprising:

an image bearing member on which an electrostatic latent image is formed;

the developing device according to claim 1 configured to develop the electrostatic latent image formed on the image bearing member; and a fixing portion.

16. An image forming apparatus comprising:

the process cartridge according to claim 14; and a fixing portion.

* * * * *